US005946719A

United States Patent [19]

Crupi et al.

[11] Patent Number: 5,946,719

[45] Date of Patent: Sep. 7, 1999

[54] NECK AND HEAD PROTECTION SYSTEM

[75] Inventors: Vincent G. Crupi, Ottawa; Donald A. Gunn, Orleans; Shaik M. Kalaam, Nepean; Harald Hermann Kleine; Richard J. L'Abbé , both of Ottawa; Aristidis Makris, Nepean; Ron A. Purvis, Orleans; Mark Smith, Ottawa, all of Canada

[73] Assignee: Med-Eng Systems, Inc., Ottawa, Canada

[21] Appl. No.: 09/137,385

[22] Filed: Aug. 20, 1998

[30] Foreign Application Priority Data

Aug. 14, 1998 [CA] Canada ..... 2241747

[51] Int. Cl.[6] ..... A42B 3/00

[52] U.S. Cl. ..... 2/6.5; 2/9; 2/98; 2/410

[58] Field of Search ..... 2/424, 455, 456, 2/2.11, 2.12, 463, 464, 465, 466, 410, 6.3, 6.5, 6.6, 415, 468, 98, 906, 909, 2.5, 9, 6.4, 6.7, 10, 11, 15

[56] References Cited

U.S. PATENT DOCUMENTS

| | | | |
|---|---|---|---|
| D. 214,547 | 7/1969 | Helmet . | |
| D. 291,256 | 8/1987 | Hollander . | |
| D. 341,230 | 11/1993 | Kamata . | |
| D. 370,310 | 5/1996 | Reuber et al. . | |
| D. 376,674 | 12/1996 | Kamata . | |
| D. 392,073 | 3/1998 | Lashley . | |
| 1,820,237 | 8/1931 | Malcom | 2/9 |
| 3,383,706 | 5/1968 | Lobelle | 2/6 |
| 3,514,784 | 6/1970 | McDavid | 2/2 |
| 3,707,004 | 12/1972 | Kapitan et al. . | |
| 3,878,561 | 4/1975 | Winiecki . | |
| 3,991,421 | 11/1976 | Stratten | 2/2 |
| 4,097,929 | 7/1978 | Lowe et al. | 2/10 |
| 4,386,277 | 5/1983 | Forshee | 2/9 |
| 4,449,251 | 5/1984 | Gauthier . | |
| 4,467,476 | 8/1984 | Herbert . | |
| 4,475,248 | 10/1984 | L'Abbe et al. | 2/2.5 |
| 4,495,657 | 1/1985 | Bay . | |
| 4,638,510 | 1/1987 | Hubbard | 2/6 |
| 4,639,944 | 2/1987 | Lashley et al. | 2/2 |
| 4,920,585 | 5/1990 | Arai | 2/424 |
| 5,005,221 | 4/1991 | Chen . | |
| 5,060,314 | 10/1991 | Lewis . | |
| 5,068,919 | 12/1991 | MacKendrick et al. | 2/2.1 A |
| 5,182,816 | 2/1993 | Arai . | |
| 5,467,480 | 11/1995 | Baudou et al. | 2/6.5 |
| 5,584,737 | 12/1996 | Luhtala . | |
| 5,652,964 | 8/1997 | Reinheardt . | |
| 5,655,374 | 8/1997 | Santilli et al. | 62/3.5 |
| 5,722,091 | 3/1998 | Keller et al. | 2/6.3 |
| 5,732,410 | 3/1998 | Machson | 2/9 |
| 5,746,442 | 5/1998 | Hoyaukin | 280/730.1 |
| 5,819,318 | 10/1998 | Tse . | |

OTHER PUBLICATIONS

"Explosive Ordance Disposal Suit", Safeco EOD Incorporated "Explosive Ordance Disposal", Armor Holdings, Inc.

*Primary Examiner*—Gloria Hale
*Assistant Examiner*—Tejash D Patel
*Attorney, Agent, or Firm*—Rockey, Milnamow & Katz, Ltd.

[57] ABSTRACT

A protective system for shielding the head and neck regions of an operative from the blast effects of exploding munitions comprises a helmet with a visor which is inwardly curved rearwardly at its lower end and interacts with a double collar arrangement of a protective suit to provide enhanced protection to the neck region of the operative.

14 Claims, 5 Drawing Sheets

NECK AND HEAD PROTECTION SYSTEM

BACKGROUND OF THE INVENTION a) Field of the Invention

This invention relates to a new or improved protective system for shielding the head and neck regions of an operative from the blast effects of exploding munitions.

b) Description of the Prior Art

Such protective systems are commonly incorporated into clothing for use by among others, mine clearance personnel, bomb disposal operatives and the like. It is imperative that such clothing provide adequate protection to the user against the fragmentation, ballistic and heat effects of an exploding bomb or mine, while at the same time avoiding excess weight and bulk so as not to unduly encumber movement of the operative. Such systems incorporate protective helmets to shield the head and neck regions of the operative, which helmets also carry visors designed to interact with the shoulder region of the protective clothing to protect the vital neck area of the operator.

U.S. Pat. No. 3,991,421 Stratten discloses a suit of blast protection armour having a helmet that is in threaded engagement with the torso part of the armour. While this arrangement provides continuous protection, it does not allow full movement of the head of the operator.

SUMMARY OF THE INVENTION

It is desired to provide a protective system for the head and neck regions of an operative which will provide an adequate degree of protection without unduly inhibiting normal head movements of the operator.

The invention accordingly provides a protective system for shielding the head and neck regions of an operative from the blast effects of exploding munitions, comprising: a helmet for fitting to the head of the operative, said helmet having an open front; a visor that is at least partially transparent and that is forwardly convexly curved from side to side, having a generally U-shape as seen from above, said visor being sized to span and cover said open front of said helmet, and having a height that corresponds to the facial height of the operative; attachment means for releasably securing said visor to said helmet in an operative position spanning and covering said open front; wherein said visor has a central lower marginal area that is rearwardly offset such that in said operative position said marginal area extends towards the neck of the operative.

Preferably the visor has opposed side wings which overlap and are detachably connected to side panels of the helmet by means of pivotal attachment at the upper part of each wing, so that the visor can be pivoted about its upper end from a deployed position covering the face of the operative to an upwardly displaced inoperative position.

Preferably the protective system is provided in conjunction with a protective suit for covering the body and neck of the operative, the suit having a shoulder section formed to fit the upper torso and supporting inner and outer collars. Preferably the central lower marginal area of the visor is designed to cooperate closely with the inner collar in protecting the throat region of the operative.

BRIEF DESCRIPTION OF THE DRAWINGS

The invention will further be described, by way of example only, with reference to the accompanying drawings wherein.

DESCRIPTION OF THE PREFERRED EMBODIMENTS

Figure 1:
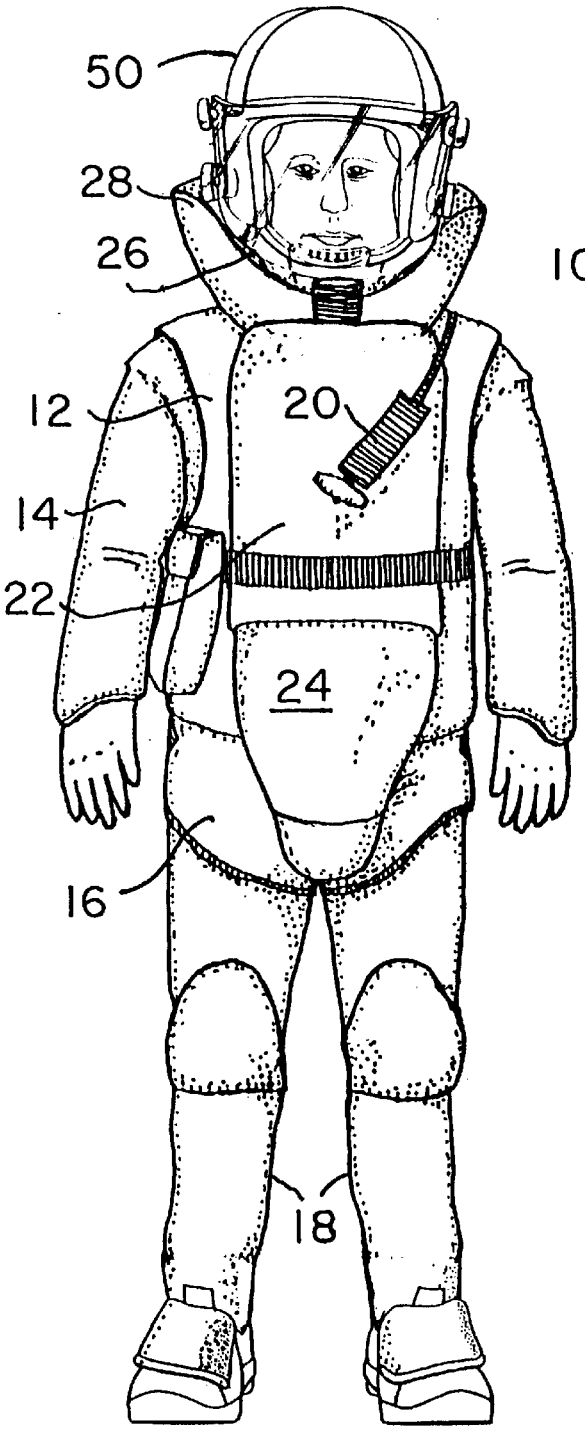
FIG. 1 is a front elevation of an operative clad in a protective system in accordance with the invention.
Figure 2:
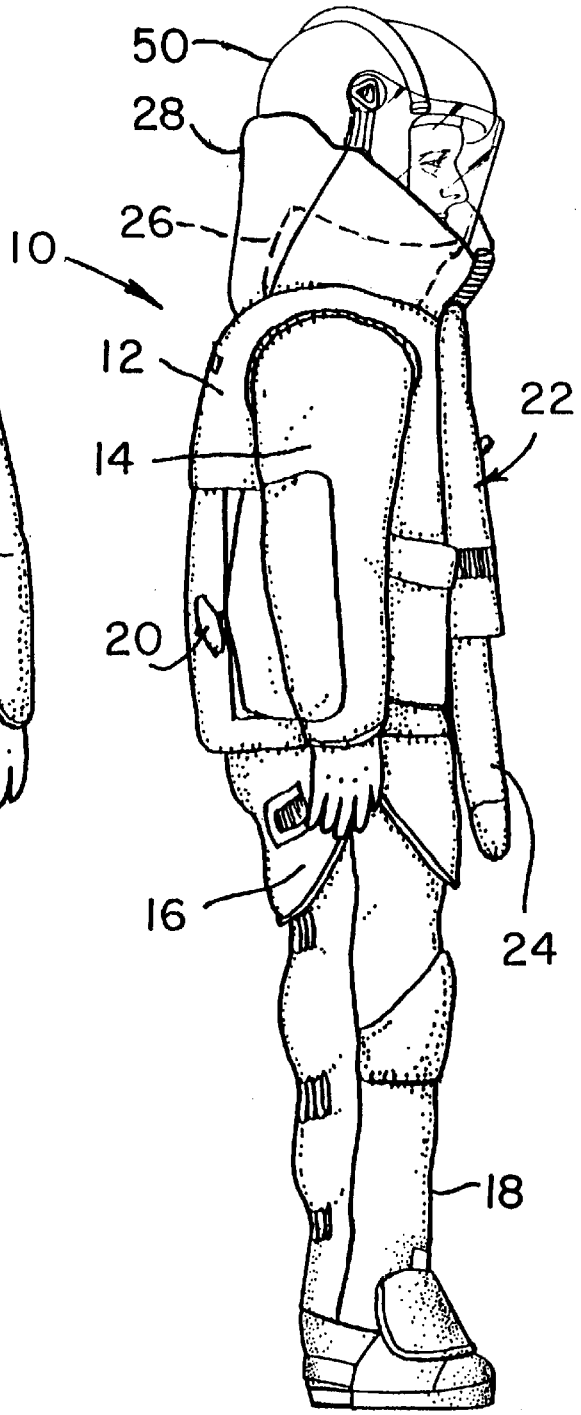
FIG. 2 is a side elevation thereof.

The overall protective system is illustrated in FIG. 1 and FIG. 2 where the operative is shown clothed in a protective suit 10 that is designed to shield the operative from the effects of heat and explosions and which comprises generally a torso section 12, arm sections 14, shorts 16 and leggings 18. These various sections include adjustment means (not shown) by which the suit can be adapted to fit the physical dimensions of the operative and will incorporate padding and reinforcement means as required to protect vital and/or vulnerable regions of the operative's body. The suit may also include toggle operated quick release fittings 20 to facilitate rapid disrobing as may be necessary for example when the suit is contacted by burning substances. In particular the suit includes a reinforced chest protector 22 and a reinforced groin protector 24, the latter preferably being configured and adjustably mounted as described in our copending U.S. patent application Ser. No. 09/070,713 filed 30 Apr. 1997.

A particularly vulnerable area of the operative is the neck region, and the protective system of the present application provides enhanced shielding in this area. More particularly, connected to the torso section 12 of the suit is a double collar arrangement comprising an inner collar 26 which is adjustable to closely surround the neck of the operative, and an outer collar 28.

As clearly shown in FIGS. 1 and 2, the outer collar extends significantly above the inner collar in the side and rear regions thereof, although it is of reduced height in the front region thereof so as not to interfere unduly with the field of vision of the operative. The outer collar 28 is narrowest at its attachment to the torso section 12 and flares somewhat outwardly in the upwards direction.

Figure 3:
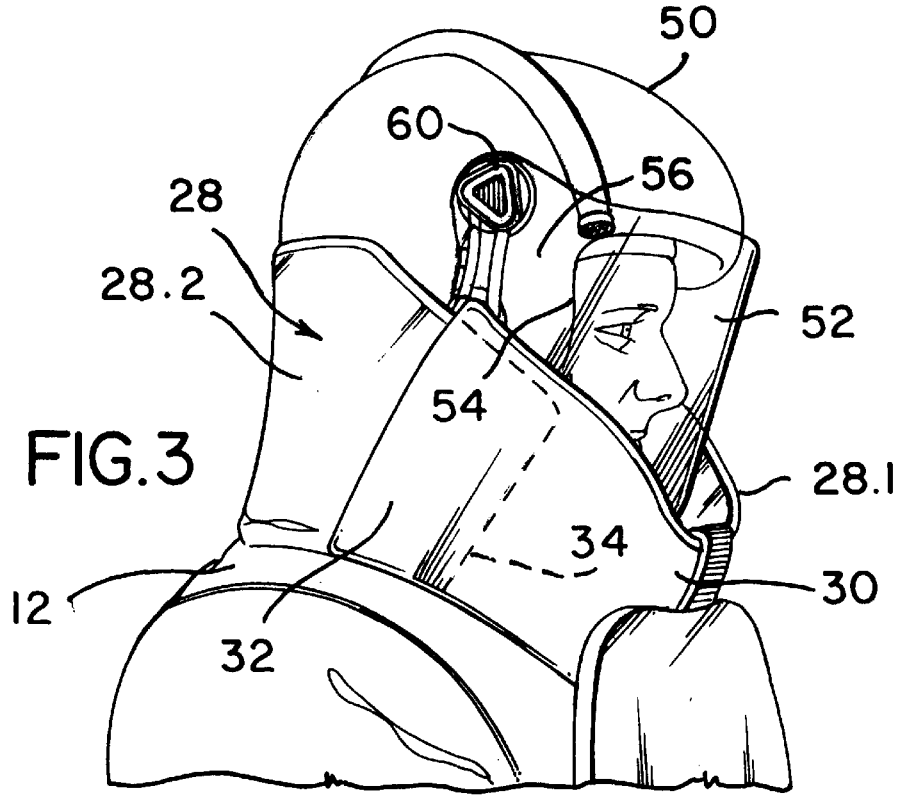
FIG. 3 is an enlarged fragmentary view of the shoulder and head region of the operative.
Figure 6:
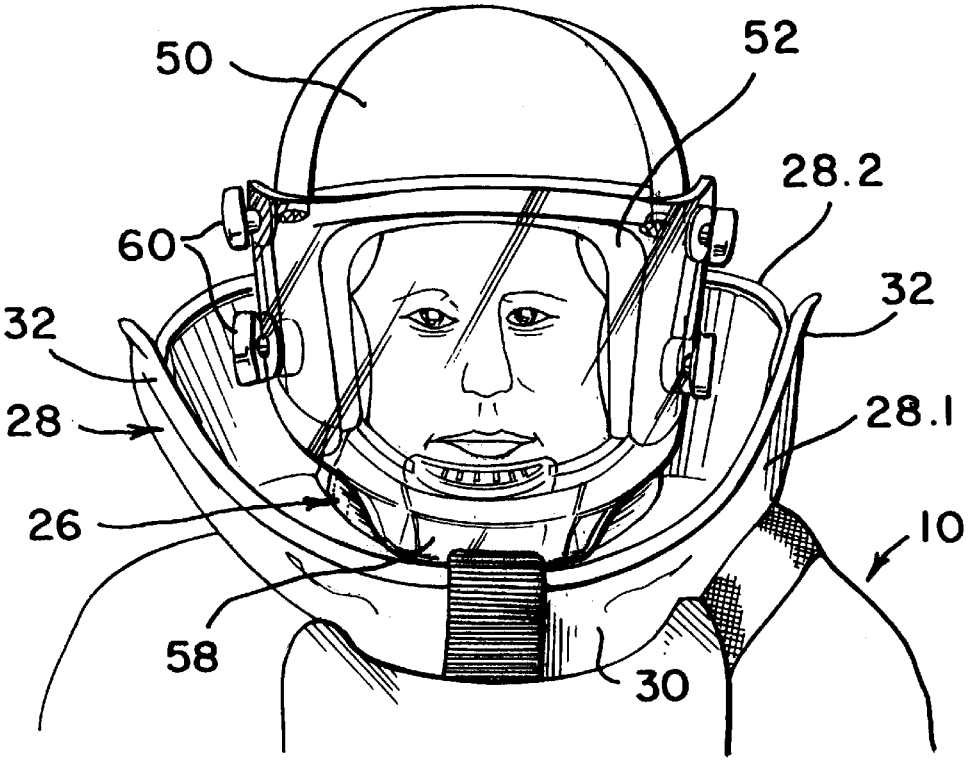
FIG. 6 is a front view corresponding to FIG. 3.
Figure 7:
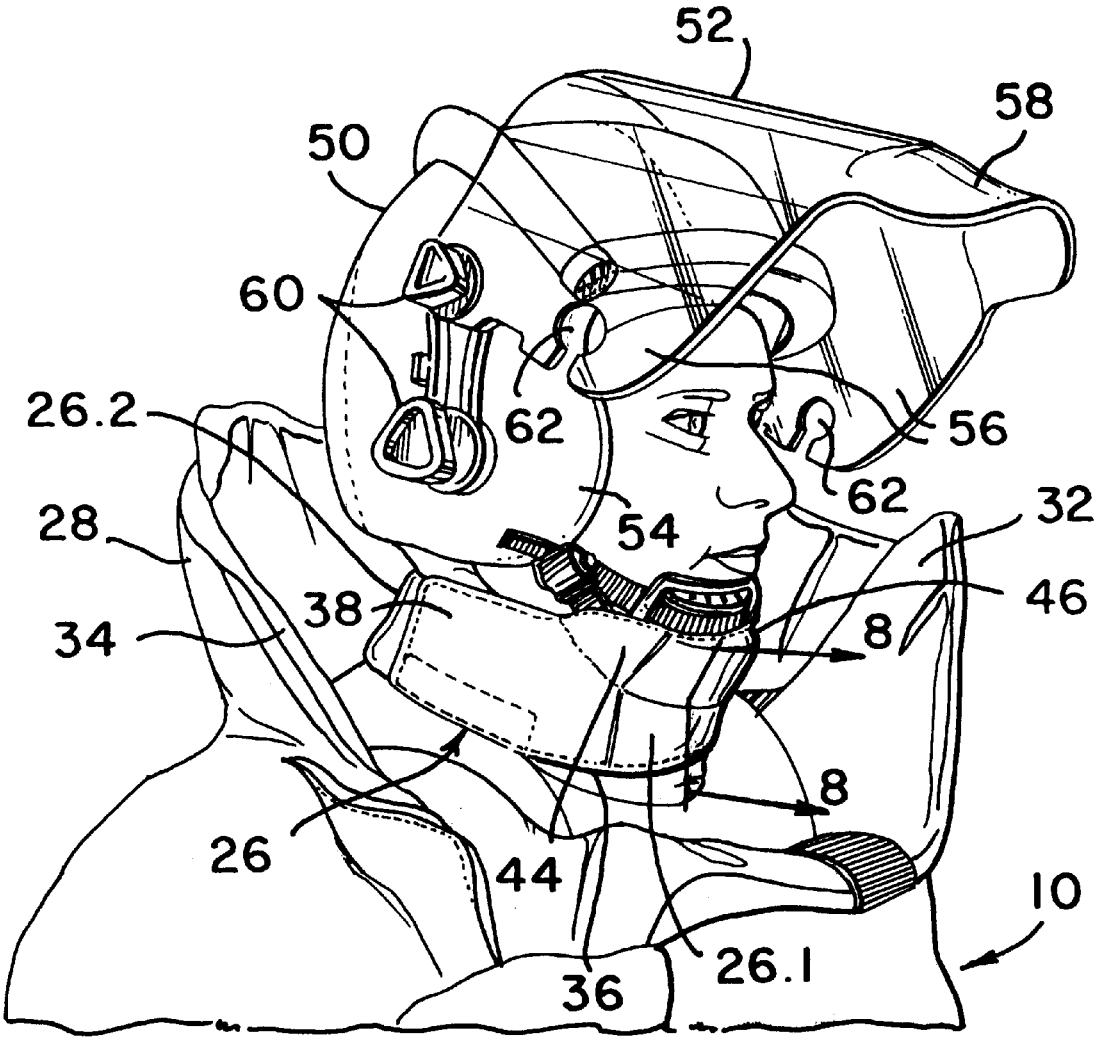
FIG. 7 is a view corresponding to FIG. 6 showing the operative with the visor raised and the outer collar opened.

As best seen in FIGS. 3, 6 and 7, the outer collar 28 comprises separable front and rear sections 28.1, 28.2. The central part 30 of the front collar section 28.1 is securely attached at its lower end to the suit torso section 12, and at each side of this central part there is a laterally projecting wing 32, the lower edge of each wing being free from attachment to the torso section 12. The rear section 28.2 of the outer collar is fixed throughout the length of its lower edge to the suit torso section 12 and has on each side a front end 34 that in the operative position shown in FIG. 3 is overlapped by the corresponding wing 32 of the front collar section. The wings 32 are attached to the associated front ends 34 by detachable fasteners such as Velcro™, and can be connected thereto with various degrees of overlap so as to effectively lengthen or shorten the periphery of the outer collar 28, thus matching the shape and position of this outer collar to the stature and comfort requirements of the operative. When the protection is not required, the wings 32 can be detached and the front and rear sections of the outer collar 28 spread apart as shown in FIG. 7.

In similar fashion, the inner collar 26 has front and rear sections 26.1, 26.2. The lower edge of the front part 36 being securely attached to the torso section 12 of the suit, and each end of the front section having a laterally and rearwardly projecting wing 38 which overlaps and is detachably secured in overlapping relation to the rear inner collar section 28.2. The connection between the wings 38 and the rear inner collar section 28.2 is by means of Velcro fasteners or the like, and is both detachable and adjustable so that the inner collar 26 can be snugly fitted to the neck of the operative. It will be appreciated that this fitting system enables the inner collar to be matched in size to a large range of neck sizes for the operative. As shown particularly in FIG. 8, both the inner collar 26 and the outer collar 28 are of reinforced flexible material and include foam fillings 40, 42 covered by layers of reinforced fabric e.g. of aramid fibers. Rigid or flexible fabric reinforced layers (not shown) may be incorporated within the foam fillings 40, 42.

Figure 8:
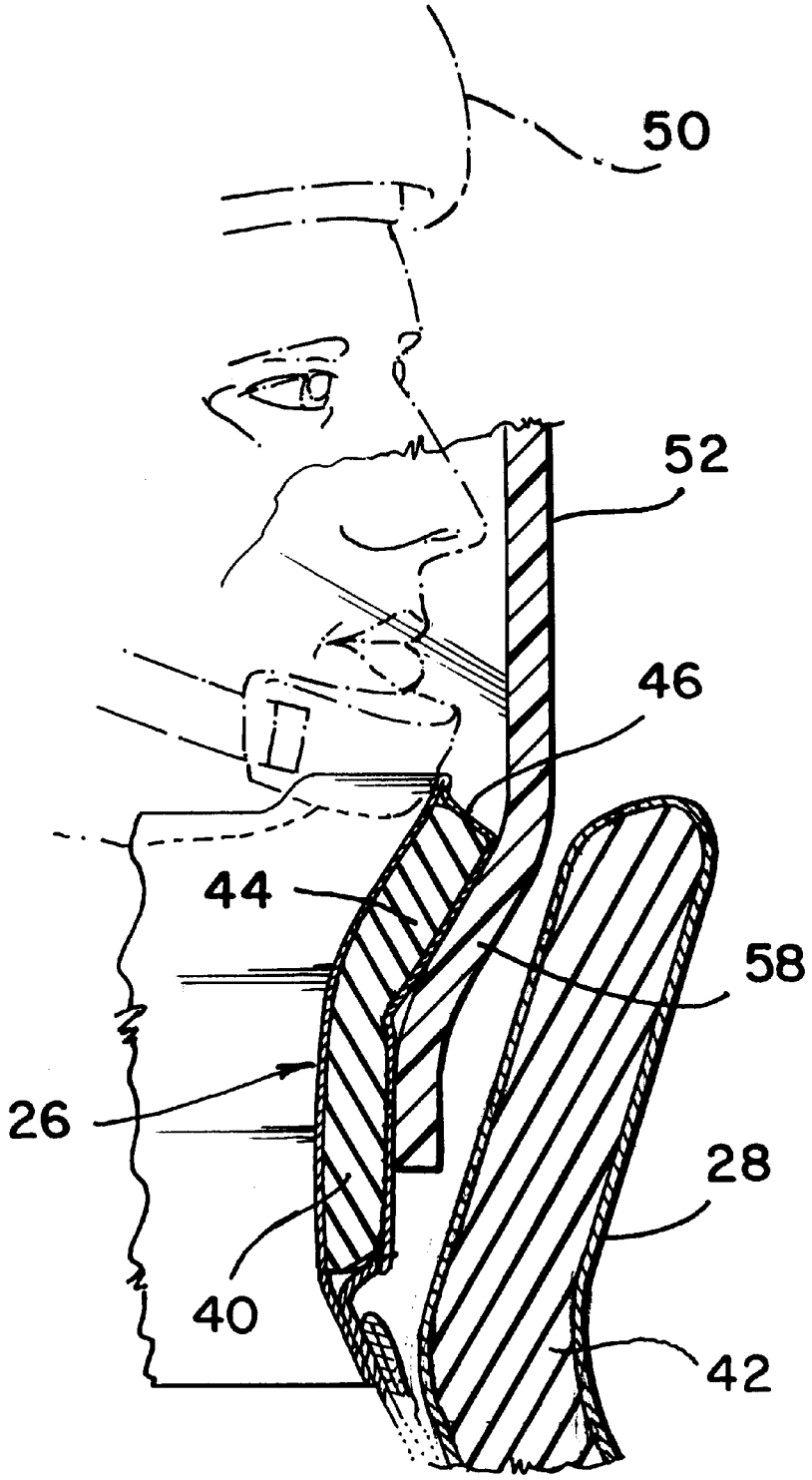
FIG. 8 is an enlarged fragmentary sectional view taken on the line 8—8 in FIG. 7.

The upper central section 44 of the inner collar 26 is forwardly angled, as best seen in FIGS. 7 and 8, to accommodate the transition between the neck and chin of the operative, and the overall height of the inner collar is such that its upper edge 46 lies somewhat above the operative's chin as shown in FIG. 8.

The head of the operative is covered by a protective helmet 50 provided with a visor 52 which covers the open front of the helmet and provides protection to the face of the operative while at the same time providing the operative with a large field of view.

Figure 4:
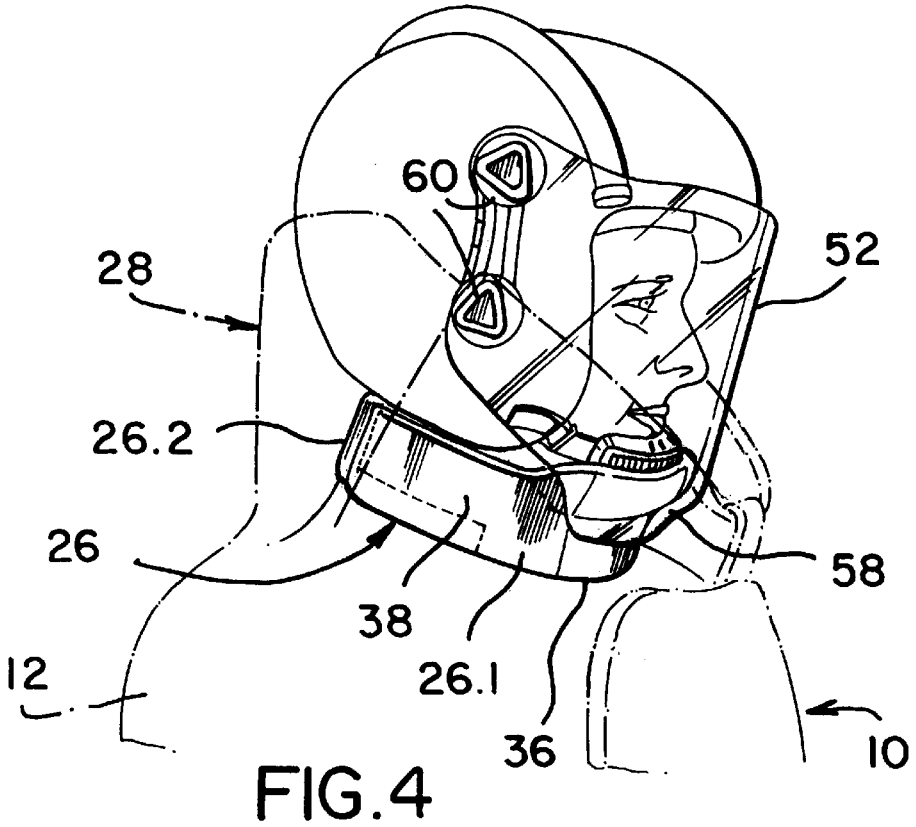
FIG. 4 is a view similar to FIG. 3 with portions omitted to reveal internal detail.
Figure 5:
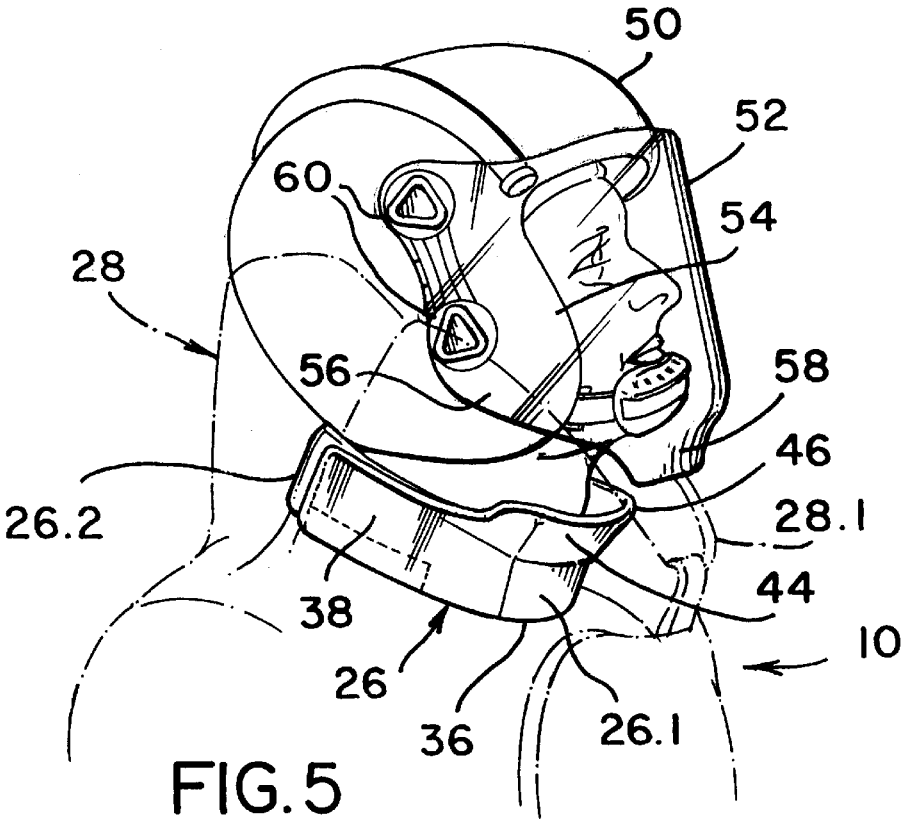
FIG. 5 is a view similar to FIG. 4 showing an alternate position.

As is best illustrated in FIGS. 2, 5 and 7, the helmet 52 covers the top, rear and sides of the operative's head and has forwardly projecting cheeks 54 on opposite sides of its open front, these cheeks providing a mounting for the visor 52. As is evident, the visor 52 is transparent being fabricated in a suitable material such as Lexan polycarbonate, or combination Lexan Acrylic or Lexan-glass, in a thickness of 5 mm to 15 mm and is transversely curved from side to side having on each side an attachment wing 56. The central portion 58 of the lower end of the visor is curved rearwardly and downwardly as is seen in FIGS. 4 and 8 to lie against and cooperate with the outer side of the front section 26.1 of the inner collar, and in particular with the outwardly curved upper central part 44 thereof.

As seen in FIG. 8 the central lower part 58 of the visor lies snugly against the outer front side of the inner collar in a gap between the latter and the outer collar 28. It will be evident that in this position the collars 26 and 28 and the visor 50 provide a large measure of protection to the neck region of the operative since any gaps in ballistic protection to the neck for all normal user operations are minimized or eliminated. Thus, as part of the integrated protective system approach, the rearwardly offset lower part 58 of the visor 52 cooperates with the collar system in providing protection and avoiding gaps in ballistic protection. This is in contrast to traditional protection systems wherein the helmet with visor were typically designed independently from the protective suit, resulting in interface problems and poor performance.

As mentioned, the rearwardly offset central lower part 58 of the visor is less than the full width of the visor, and as seen in front view (FIG. 6) has a width that corresponds generally to the width of the operative's neck. In other words, the visor 50 considered as a whole is designed to look proportional to the projected frontal area of the head and neck of the operative.

It will be appreciated that the integrity of the head/neck protection is maintained through all normal ranges of head movement that would be carried out by the operative in performance of his duties i.e. the interengagement of the visor lower end 58 in overlapping relationship to the inner collar 26 will be maintained when the operator rotates his head to one side or the other, and when the operator lowers his head from the forwardly oriented disposition shown in FIG. 8, i.e. when the operative has to look downwards. FIG. 5 indicates that a gap opens between the upper edge 46 of the inner collar and the lower part 58 of the visor when the operative swings his head upwardly. However the attitude illustrated in FIG. 5 is not a normal one, and as a practical matter would very seldom be encountered in use of the protective system, bearing in mine that the normal use will be in mine clearance or bomb disposal operations during which the operative will usually have his head at a downwardly inclined attitude.

The curved contour of the lower part 58 of the visor is designed to slide smoothly between the outer and inner collars so as to offer little or no interference to motion of the operative's head. This narrower lower portion 58 of the visor improves the aerodynamics of the visor when subjected to a blast force originating from an explosion, and reduces the projected frontal area for blast wave reflection.

Attachment of the visor to the helmet is by means of four hand-operated threaded fasteners 60 two of which are arranged on each side of the helmet as shown. The upper fasteners 60 are coaxial and are threaded through the wings 56 of the visor forming a pivot axis about which the visor can be swung from the operative position shown in FIGS. 3 to 6 upwardly to the retracted position shown in FIG. 7. In each wing 56 of the visor there is a slotted aperture 62 which passes over the lower fastener 60 in the operative position, the fastener 60 being manually rotated to clamp the visor wing 56 against the helmet cheek 54.

To better accommodate the protective system to individuals of varying statute, the visor may be provided in a variety of lengths, a first version being of increased length from top-to-bottom to accommodate individuals of taller stature, and a second version being somewhat shortened in vertical length to accommodate individuals of shorter stature.

We claim:

1. A protective system for shielding the head and neck regions of an operative from the blast effects of exploding munitions, comprising:

a helmet for fitting to the head of the operative, said helmet having an open front;

a visor that is at least partially transparent and that is forwardly convexly curved from side to side, having a generally U-shape as seen from above, said visor being sized to span and cover said open front of said helmet, and having a height sufficient to cover the facial height and throat of the operative;

attachment means for releasably securing said visor to said helmet in an operative position spanning and covering said open front;

wherein said visor has in a region thereof corresponding to the position of the chin and neck of the operative a rearwardly angled transition section leading to a central lower marginal area that is rearwardly offset such that in said operative position said marginal area extends towards the neck of the operative.

2. A protective system as claimed in claim 1 further including a protective suit for covering the body and neck of the operative, said suit having a shoulder section formed to fit the upper torso of the operative, said shoulder section supporting a collar structure comprising:

an inner collar sized to closely surround the neck of the operative; and an outer collar surrounding said inner collar in spaced relation thereto; each said collar having a lower end that is attached to said shoulder section, said inner collar having a height corresponding to that of an operator's neck, said outer collar having a height that increases from a front region thereof to a rear region thereof, said front region being substantially aligned with the upper end of the inner collar and spaced therefrom, whereas said outer collar has side and rear regions of increasing height.

3. A protective system as claimed in claim 2 wherein in said operative position said lower marginal area of said visor is positioned in the spacing between said outer collar and said inner collar, and lies closely adjacent the latter.

4. The protective system as claimed in claim 3 wherein said outer collar is outwardly flared in the upwards direction such as to provide sufficient clearance around the helmet and visor to enable the operative to perform normal turning and tilting head movements.

5. A protective suit as claimed in claim 4 wherein said inner collar has a front part with a forwardly flared upper marginal region angled to correspond to the transition between neck and chin of the operator.

6. A protective system as claimed in claim 5 wherein said inner collar is adjustable in circumference to enable it to be closely matched to the sides of the operator's neck.

7. A protective suit as claimed in claim 3 wherein said inner collar has a front part with a forwardly flared upper marginal region angled to correspond to the transition between neck and chin of the operator.

8. A protective system as claimed in claim 7 wherein said inner collar is adjustable in circumference to enable it to be closely matched to the sides of the operator's neck.

9. The protective system as claimed in claim 4 wherein said outer collar is outwardly flared in the upwards direction such as to provide sufficient clearance around the helmet and visor to enable the operative to perform normal turning and tilting head movements.

10. A protective system for shielding the head and neck regions of an operative from the blast effects of exploding munitions, comprising:

a helmet for fitting to the head of the operative, said helmet having an open front;

a visor that is at least partially transparent and that is forwardly convexly curved from side to side, having a generally U-shape as seen from above, said visor being sized to span and cover said open front of said helmet, and having a height that corresponds to the facial height of the operative;

attachment means for releasably securing said visor to said helmet in an operative position spanning and covering said open front;

wherein said visor has a central lower marginal area that is rearwardly offset such that in said operative position said marginal area extends towards the neck of the operative;

in combination with a protective suit for covering the body and neck of the operative, said suit having a shoulder section formed to fit the upper torso of the operative, said shoulder section supporting a collar structure comprising:

an inner collar sized to closely surround the neck of the operative; and an outer collar surrounding said inner collar in spaced relation thereto; each said collar having a lower end that is attached to said shoulder section, said inner collar having a height corresponding to that of an operator's neck, said outer collar having a height that increases from a front region thereof to a rear region thereof, said front region being substantially aligned with the upper end of the inner collar and spaced therefrom, whereas said outer collar has side and rear regions of increasing height.

11. A protective system as claimed in claim 10 wherein in said operative position said lower marginal area of said visor is positioned in the spacing between said outer collar and said inner collar, and lies closely adjacent the latter.

12. The protective system as claimed in claim 1 wherein said outer collar is outwardly flared in the upwards direction such as to provide sufficient clearance around the helmet and visor to enable the operative to perform normal turning and tilting head movements.

13. A protective suit as claimed in claim 12 wherein said inner collar has a front part with a forwardly flared upper marginal region angled to correspond to the transition between neck and chin of the operator.

14. A protective system as claimed in claim 13 wherein said inner collar is adjustable in circumference to enable it to be closely matched to the sides of the operator's neck.

* * * * *

UNITED STATES PATENT AND TRADEMARK OFFICE

CERTIFICATE OF CORRECTION

PATENT NO.: 5,946,719

DATED : September 7, 1999

INVENTOR(S): Crupi et al.

It is hereby certified that error appear(s) in the above-identified patent and that said Letters Patent is hereby corrected as shown below:

In claim 12, in line 1, "claim 1" should read -- claim 11 --

Signed and Sealed this

Twenty-second Day of February, 2000

*Attest:*

Q. TODD DICKINSON

*Attesting Officer*

*Commissioner of Patents and Trademarks*